US007608002B2

(12) United States Patent
Eastman, II et al.

(10) Patent No.: US 7,608,002 B2
(45) Date of Patent: Oct. 27, 2009

(54) COMPOSITE ARROW SHAFT INCLUDING TWO-PART REINFORCING SLEEVE, METHOD OF MAKING SAME, AND FRONT-LOADED ARROW WHICH IS PRODUCED THEREWITH

(75) Inventors: Robert Eastman, II, Flint, MI (US); Leonard D. Rezmer, Flushing, MI (US)

(73) Assignee: Eastman Holding Company, Flushing, MI (US)

( * ) Notice: Subject to any disclaimer, the term of this patent is extended or adjusted under 35 U.S.C. 154(b) by 231 days.

(21) Appl. No.: 11/513,825

(22) Filed: Aug. 31, 2006

(65) Prior Publication Data

US 2008/0058133 A1 Mar. 6, 2008

(51) Int. Cl.
*F42B 6/04* (2006.01)

(52) U.S. Cl. ..... 473/578

(58) Field of Classification Search ..... 473/578
See application file for complete search history.

(56) References Cited

U.S. PATENT DOCUMENTS

| | | | | |
|---|---|---|---|---|
| 2,694,661 | A | 11/1954 | Meyer | |
| 3,770,556 | A | 11/1973 | Evans et al. | |
| 3,865,374 | A | 2/1975 | Troncoso, Jr. | |
| 3,957,271 | A * | 5/1976 | Kurtz et al. | 473/586 |
| 4,050,696 | A | 9/1977 | Troncoso, Jr. | |
| 4,234,190 | A | 11/1980 | Airhart | |
| 4,268,038 | A | 5/1981 | Wierenga | |
| 4,489,949 | A | 12/1984 | Taylor et al. | |
| 4,533,146 | A | 8/1985 | Schaar | |
| 4,534,568 | A | 8/1985 | Tone | |
| 4,706,965 | A | 11/1987 | Schaar | |
| 4,795,165 | A | 1/1989 | Tehan | |
| 4,900,038 | A | 2/1990 | Czetto et al. | |
| 5,035,764 | A | 7/1991 | Blake | |
| 5,090,149 | A | 2/1992 | Muk Kim | |
| 5,242,720 | A | 9/1993 | Blake | |
| 5,295,692 | A | 3/1994 | Wright | |
| 5,324,558 | A | 6/1994 | Muto et al. | |
| 5,385,767 | A | 1/1995 | Noguchi | |
| 5,443,272 | A | 8/1995 | Vincent, Sr. | |
| 5,538,769 | A | 7/1996 | Sandman, Jr. | |
| 5,549,947 | A | 8/1996 | Quigley et al. | |
| 5,686,155 | A | 11/1997 | Suzue et al. | |
| 5,721,030 | A | 2/1998 | Okada | |
| 5,763,035 | A | 6/1998 | Andre De La Porte et al. | |
| 5,842,942 | A | 12/1998 | Doht et al. | |
| 5,964,056 | A | 10/1999 | Grice | |

(Continued)

*Primary Examiner*—John Ricci
(74) *Attorney, Agent, or Firm*—Carrier, Blackman and Associates, P.C.; William D. Blackman; Joseph P. Carrier

(57) ABSTRACT

A reinforced archery arrow shaft includes a tubular core, with an attached two-part sleeve either covering the core, or disposed inside the core as a liner. The core may include carbon therein. The sleeve includes at least one higher-density front section formed from a fabric material, which is wrapped around and affixed to the core. The sleeve also includes a lower-density rear section wrapped around and affixed to the core behind the front section. The sleeve fabric may have a decorative design or pattern on the exterior surface thereof. The higher density of the front section provides front-of-center weight distribution in the finished arrow shaft. Optionally, accessories may be attached to the arrow shaft to form an arrow.

14 Claims, 6 Drawing Sheets

U.S. PATENT DOCUMENTS

| | | | | |
|---|---|---|---|---|
| 5,968,621 | A | 10/1999 | Okada | |
| 5,997,970 | A | 12/1999 | You | |
| 6,129,962 | A | 10/2000 | Quigley et al. | |
| 6,179,736 | B1 | 1/2001 | Thurber | |
| 6,251,036 | B1 | 6/2001 | Wu et al. | |
| 6,276,401 | B1 | 8/2001 | Wilson | |
| 6,277,041 | B1 * | 8/2001 | Fenn | 473/578 |
| 6,520,876 | B1 | 2/2003 | Eastman, II | |
| 6,534,140 | B2 | 3/2003 | Hargett, Jr. et al. | |
| 6,554,725 | B1 | 4/2003 | Schaar | |
| 6,554,726 | B2 | 4/2003 | Thurber | |
| 6,821,219 | B2 * | 11/2004 | Thurber | 473/578 |
| 6,866,599 | B2 | 3/2005 | Eastman, II | |

* cited by examiner

COMPOSITE ARROW SHAFT INCLUDING TWO-PART REINFORCING SLEEVE, METHOD OF MAKING SAME, AND FRONT-LOADED ARROW WHICH IS PRODUCED THEREWITH

BACKGROUND OF THE INVENTION

1. Field of the Invention

The present invention relates to a reinforced archery arrow shaft, including a hollow tubular core having an integral two-part reinforcing sleeve, where the sleeve is disposed in lining or covering relation on the core, or else is sandwiched between the core and at least one other layer. The present invention also relates to a method of making the arrow shaft, and to a front-loaded arrow which is made using the described shaft.

More particularly, the present invention relates to a composite arrow shaft including a hollow tubular core, a two-part reinforcing sleeve either surrounding the core, lining the core or sandwiched between the core and at least one other layer, where the sleeve is integrally attached to the core, and includes an adhesive resin material impregnated into each component of the two-part reinforcing sleeve; as well as to an arrow made using the shaft and a method of making the shaft.

In a specific embodiment, the present invention relates to an arrow shaft of the type described, in which an outer reinforcing sleeve is used outside of the core, and a decoration or pattern is applied to a woven or non-woven fabric, which forms a front portion of the outer reinforcing sleeve, before it is placed outside of, and covering the core.

2. Description of the Background Art

Many different types of arrows are known for use in hunting and in sport archery. Many different arrows may be found in class 473, subclass 578, and the subclasses immediately following.

Examples of some of the issued patents disclosing archery arrows include U.S. Pat. Nos. 4,234,190, 4,489,949, 4,533,146, 4,534,568, 4,795,165, and 4,900,038.

It has become fairly standardized for archery arrows to be made using a graphite or other carbon-containing material in the construction of the hollow arrow shaft. Tubular metal shafts have, alternatively, also been used.

However, there are some drawbacks with the use of carbon composite arrow shafts, including the tendency of some of the arrow shafts to become slightly warped during curing thereof, in the manufacturing process, leading to scrap.

Another limitation on conventional carbon composite arrow shafts is that, although they are adequate for normal usage, under heavy-duty use and in extreme conditions, such arrow shafts may fail.

Hunting arrows are placed under significant stresses during the placement of the arrows in bows, during release, and during the entry of the arrow into a target. If these types of stresses become more than the arrow shaft can withstand, carbon composite arrows may crack, break or splinter, thus necessitating the expense of purchasing replacement arrows.

Although such arrow failure is relatively uncommon and exceptional, improvements in arrow technology are always welcome. Experienced hunters and sportsmen often seek out premium quality products, which are the most reliable and durable available.

The present applicant has patented fabric-wrapped arrows with a carbon core in U.S. Pat. Nos. 6,520,876 and 6,866,599.

A number of arrows are known which teach a "front-of-center" weight distribution in which more weight is placed forward of the arrow midpoint than is placed behind the midpoint. Examples of this type of arrow can be found in U.S. Pat. Nos. 6,179,736, 6,554,725, and 6,554,726.

Although the known devices have some utility for their intended purposes, a need still exists in the art for improved archery arrow shafts.

A need exists for an arrow shaft having a strengthened and reinforced tubular core, and which also is constructed and arranged to have a front-of-center weight distribution.

A need also exists for decorated archery arrows with a front-of-center weight distribution, which carry an image or pattern thereon, in which the pattern is durable and long-lasting.

A need also exists for an arrow shaft using an improved design for front-of-center weight distribution without requiring auxiliary weights to be added to the shaft.

SUMMARY OF THE INVENTION

The present invention provides an improved archery arrow shaft, including a tubular core, with a two-part sleeve attached to the core, where the two-part sleeve is either inside of the core as a lining, is present as a sandwich layer between the core and an external cover layer, or is situated outside, covering and surrounding the core.

The two-part sleeve may include a fabric section which is formed from a rectangular piece of woven or non-woven fabric material, which has been wrapped around and affixed to the core.

Alternatively, the fabric section may be formed from a thin, continuous strip of fabric material, which is wrapped spirally and in covering relation around the arrow core.

In a specific embodiment of the invention, the fabric section of the sleeve is disposed on the exterior of the arrow shaft so that it is visible to an observer, and the fabric section is formed from a patterned fabric, which has been imprinted with a decorative design or pattern on the exterior surface thereof.

The present invention also encompasses a method of making an arrow shaft having a partially fabric-reinforced core. In practicing the method according to an illustrative embodiment of the invention, first, one or more sheets of carbon prepreg material are wrapped around a cylindrical metal mandrel to define the core.

A piece of relatively dense woven or non-woven fabric material is then placed in covering relation on a front section of the tubular core. Then, a separate piece of lighter material, which may be a carbon composite prepreg or a lighter cloth material, is placed on another section of the core.

Then, a resin on the fabric material is cured to adhere the fabric to the core. The resin may be impregnated into the fabric prior to its placement on the core, or alternatively, may be applied to the fabric by conventional methods such as spraying, dipping, brushing, or powder coating, after the fabric is applied to the core.

The resin may be applied as a liquid and air-dried, or alternatively, may be a thermosetting resin, which is cured by heating.

In a variation of the basic method, the two-part sleeve may be affixed to the core by resin which is incorporated in the interstices of the fabric, when the resin is cured.

In a specific embodiment hereof, a fabric material at a front portion of the sleeve may be applied to the outside of the core, and may also be pre-printed or otherwise inscribed with a design or pattern before being applied to the core.

Accordingly, it is an object of the present invention to provide a fabric-reinforced archery arrow shaft with front-of-center weight distribution, and to a method of producing such an arrow shaft.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 6 is a graphical flow chart showing a sequence of steps in a specific method according to the invention.

DETAILED DESCRIPTION OF ILLUSTRATIVE EMBODIMENTS

Figure 1:
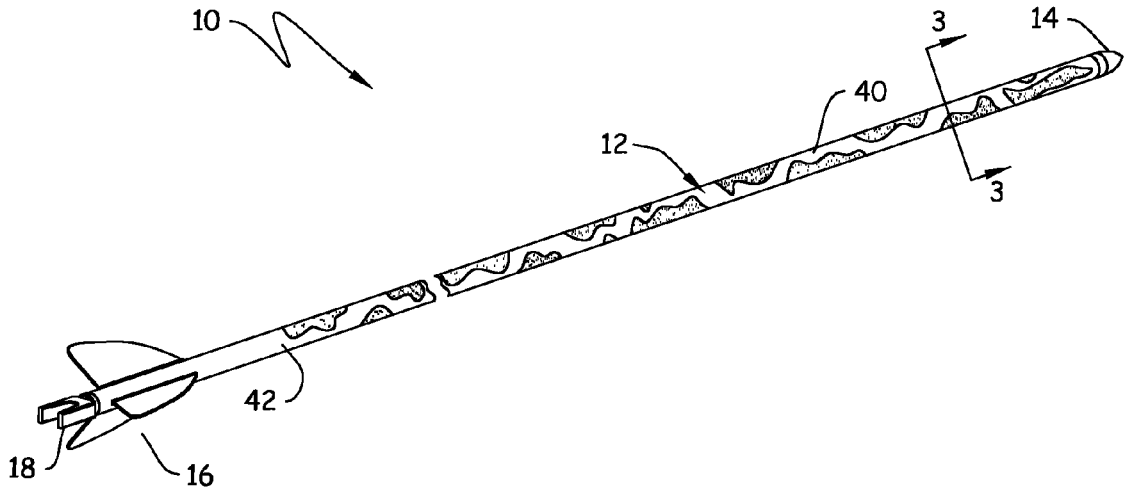
FIG. 1 is a perspective view of an archery arrow including a reinforced arrow shaft according to a specific embodiment of the invention.
Figure 2:
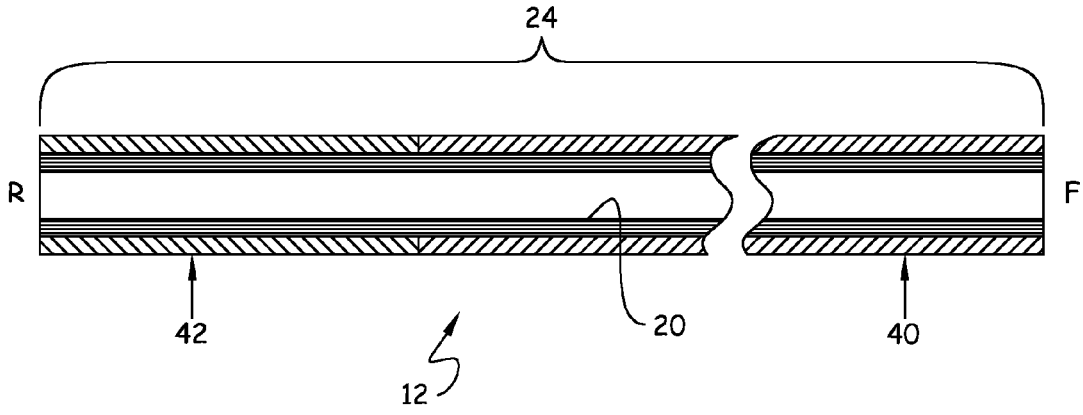
FIG. 2 is a longitudinal cross-section of the arrow shaft of FIG. 1A.

Referring now to FIGS. 1-4 of the drawings, a reinforced arrow, according to a first illustrative embodiment of the invention, is shown generally at 10. The arrow 10 includes a tubular composite reinforced arrow shaft 12, and a number of auxiliary accessories attached to the shaft, including a tip or arrow head 14, fletching 16, and a nock 18.

The shaft 12 includes a hollow tubular core 20, which can be made entirely out of laminated carbon prepreg or other lightweight carbon composite material(s). Alternatively, the core 20 may be formed from fiberglass, from a resin-impregnated fabric, from metal tubing such as aluminum or an aluminum alloy, of from a laminated combination or hybrid of fiberglass and a carbon-based material. In one embodiment, the core may have a continuous, constant inside and outside diameter throughout.

Alternatively, in another embodiment (not shown), one end of the core 20 may be tapered, or may have a larger diameter than the opposite end.

Figure 3:
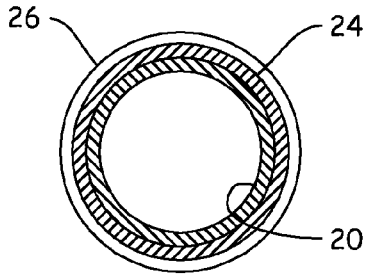
FIG. 3 is a cross-sectional view of the arrow shaft of FIG. 1, taken along the line 3-3 thereof.
Figure 4:
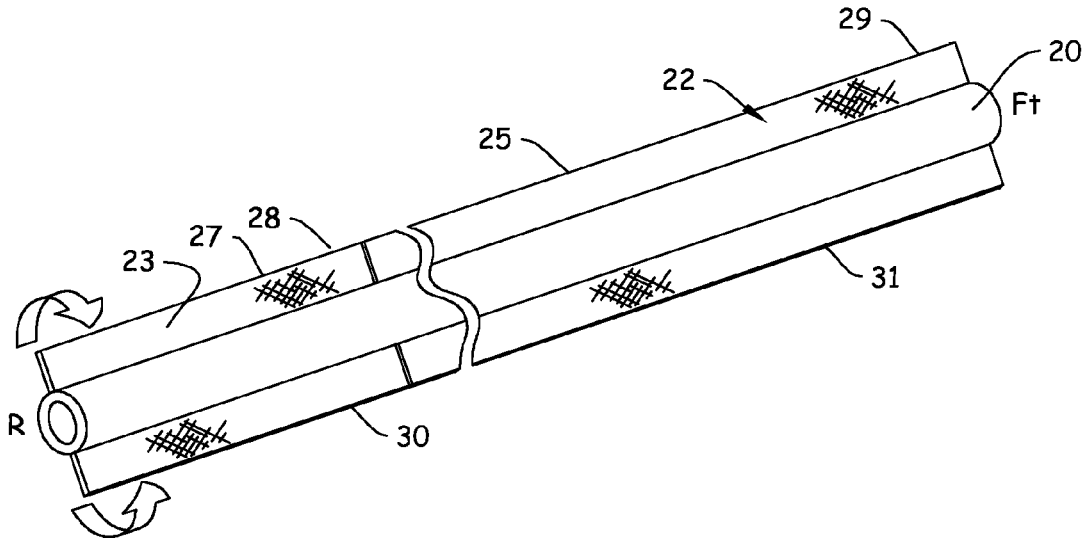
FIG. 4 is a perspective view of a the tubular core which is a component of the arrow shaft of FIG. 1, also showing a rectangular section of fabric material for forming a sleeve around the core in a first illustrative embodiment.
Figure 5:
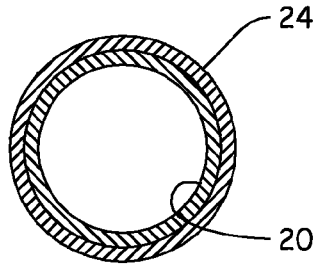
FIG. 5 is a cross-sectional view of an alternative version of the arrow shaft of FIG. 1A, taken along the line 3-3 thereof.

In the embodiment shown in FIGS. 1-4, and as seen best in FIG. 4, the shaft 12 is reinforced by wrapping a first piece 22 of relatively heavy (dense) fabric or other flexible material around the core 20 at a front portion thereof, to form a front portion 40 (FIGS. 1-2) of a sleeve 24 (The sleeve is external to the core 20 in this first embodiment). Metal screening, foil, or thin metal tubing may be used in addition to, or in place of the denser fabric section. Alternatively, a single-density fabric may be used for both sections of the sleeve, and an additional metal screen portion may be placed underneath the fabric sleeve, or alternatively, may be used to surround the fabric sleeve, in the front portion of the arrow shaft.

The material used for the front portion of the sleeve has a first density, or weight per standard linear measure such as per inch or per cm, for a given width of the material at a standard thickness thereof. This may be accomplished by using a heavy fabric, or by combining the fabric with a metal screen, as noted.

As also seen in FIG. 4, in making the arrow shaft 12 according to the first embodiment, a second piece 23 of relatively light fabric or other flexible material is wrapped externally around the core 20 at a rear portion thereof, to form a rear portion 42 of the sleeve 24.

The material used for the rear portion 42 of the sleeve has a second density which is less (lighter) than the first density, so that the rear portion 42 of the arrow shaft 12, at the nock end, becomes lighter per standard length than the front portion 40, and the weight of the arrow shaft is distributed with more weight disposed in front of the arrow's midpoint than behind the midpoint. In other words, the arrow shaft is weight-loaded front of center, and if the shaft is balanced at its midpoint, it will tip towards the front end thereof. If desired, multiple weight-forward layers may be applied to make the sleeve 24 a laminated member.

This front-of-center weight distribution is believed to make the arrow better to use, in practice and field hunting, than an arrow which is constant in weight and density at all points along the shaft. Without wishing to be bound by any theory, the front-of-center weight distribution is believed to be advantageous in allowing the arrow to recover more quickly from initial oscillations, after leaving the bow, than an arrow with constant weight distribution throughout the shaft, and therefore is believed to provide a smoother flight.

The arrow construction according to the invention accomplishes this front-of-center construction without requiring any auxiliary weights to be added to the shaft.

In one particular embodiment, the present invention provides a composite arrow shaft which is weighted front-of-center, yet which has a constant, fixed inside diameter as well as a constant fixed outside diameter along substantially the entire length of the shaft. The arrow shaft according to this embodiment is, therefore, able to accomplish a front-of-center weight distribution without requiring tapering of the arrow shaft 12.

As an example, the material used for the front portion 40 of the sleeve may be a relatively dense cotton or fiberglass material, and the material used for the rear portion of the sleeve may be a lighter weight cotton material, or a pre-impregnated carbon composite mat, known in the art as a prepreg. Where a prepreg is used, it may be a multi-layer laminated prepreg.

Then, a resin composition associated with the material sections 22, 23 is cured in place on the sleeve 24, to form a transparent coating 26 thereon (FIG. 3).

In the embodiment of FIG. 4, the material sections 22, 23 used to form the sleeve are formed as a pair of narrow, abutting rectangular sheets 25, 27, which are oriented with their respective opposed side edges 28, 30 and 29, 31 oriented parallel to the central longitudinal axis of the core 20. The sheets are then wrapped closely around the core to form the sleeve 24. Where the sleeve 24 is formed in this way, the sheets 25, 27 may be wrapped around the core 20 so that their opposed side edges 28, 30 and 29, 31 abut and touch one another. Alternatively, the rectangular sheets 25, 27 may be wrapped around the core 20 so that a first side edge 28, 29 covers and overlaps a respective second side edge 30, 31.

The fabric material 22, 23 may be a woven or a nonwoven fabric. Knit fabrics are considered to be woven fabrics in the practice of the invention.

The material of the fabric may be selected from the group consisting of nylon, polyester, cotton, KEVLAR™, or other material known in the art.

In a specific embodiment of the invention, with the fabric sleeve outside of the core, the front section of the sleeve 24 is formed from a patterned fabric, which has been imprinted or otherwise inscribed with a decorative design or pattern on the exterior surface thereof. In the embodiment of FIG. 1A, a camouflage pattern is shown on the front portion 40 of the sleeve 24.

Figure 6:
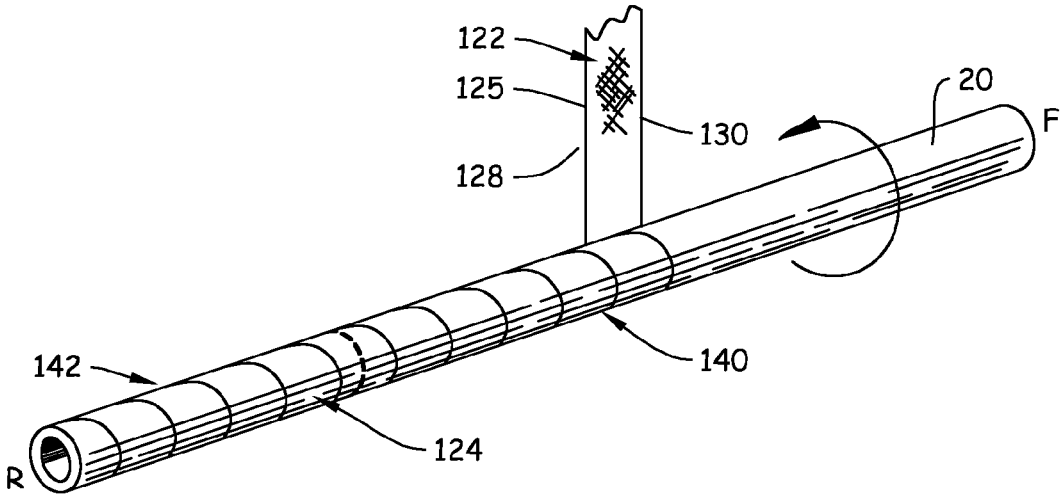
FIG. 6 is a perspective view of a tubular core which is a component of the arrow of FIG. 1, also showing a thin strip of fabric material for forming a sleeve around the core, the fabric material being wrapped spirally and in covering relation around the core in a second illustrative embodiment.

Alternatively, and as shown in FIG. 6, in a second embodiment of the present invention, a two-part sleeve 124 may be formed by wrapping a respective thin, elongated strip 125 of a fabric or other flexible material 122 in spiral fashion around the core 20 for each of the front and rear portions 140, 142 of the sleeve, respectively. Again, in this second embodiment, the material used for the front portion 140 is a heavier, denser material than the material used for the rear portion 142, or may be supplemented by a metal screen in the front portion.

Where the sleeve 124 is formed in this way, the strip 125 may be wrapped around the core 20 so that its opposed side edges 128, 130 abut and touch one another. Alternatively, the strip 125 may be wrapped around the core 20 so that a first side edge 128 covers and overlaps a second side edge 130.

The resin or protective composition may be applied to the exterior of the two-part sleeve 24 to form a transparent protective outer layer 26, as shown in FIG. 3.

Alternatively, the resin or protective composition may be impregnated into the interstices of the fabric material 22, 122 so that the resin is distributed through the sleeve 24. In one embodiment, the resin in the fabric 22, 122 bonds the fabric to the core 20 when the resin is cured.

By way of example and not limitation, dipping the fabric into a liquid solution, suspension or emulsion of uncured resin is one way of distributing the resin into the interstices of the fabric. Alternatively, this may be accomplished by spraying a liquid under pressure into the fabric, where the liquid contains uncured resin.

Figure 7:
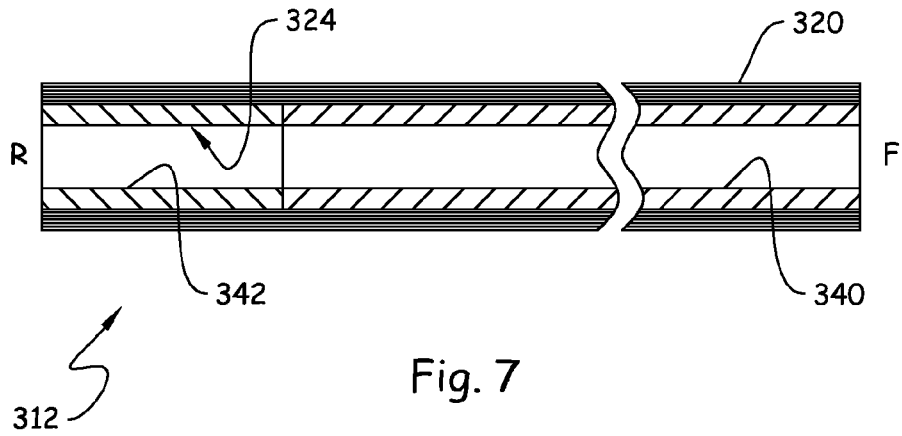

Referring now to FIG. 7, a third embodiment of an arrow shaft is shown generally at 312 in cross-section. The shaft 312 includes a hollow tubular core 320, which is essentially the same as the tubular core 20 as previously described. The core 320 may be made of a carbon composite, carbon-containing material or any of the materials discussed above in connection with the core 20.

In the embodiment shown in FIG. 7, the shaft 312 is reinforced by placing a first piece of relatively heavy (dense) fabric or other flexible material internally within the core 320 at a front portion thereof, to form a front portion 340 of a sleeve 324 (The sleeve is inside of the core 320 in this third embodiment).

The material used for the front portion 340 of the sleeve has a first density, or weight per standard linear measure, for a given width of the material at a standard thickness thereof.

Further in making the arrow shaft 312 according to the third embodiment, a second piece of relatively light fabric or other flexible material is placed internally within the core 320 at a rear portion thereof, to form a rear portion 342 of the sleeve 324.

The material used for the rear portion 342 of the sleeve has a second density which is less (lighter) than the first density, so that the rear portion 342 of the arrow shaft 312 becomes lighter per standard length than the front portion 340, and the weight of the arrow shaft is distributed with more weight disposed in front of the arrow's midpoint than behind the midpoint. If desired, multiple weight-forward layers may be applied to make the sleeve 324 a laminated member.

Figure 8:
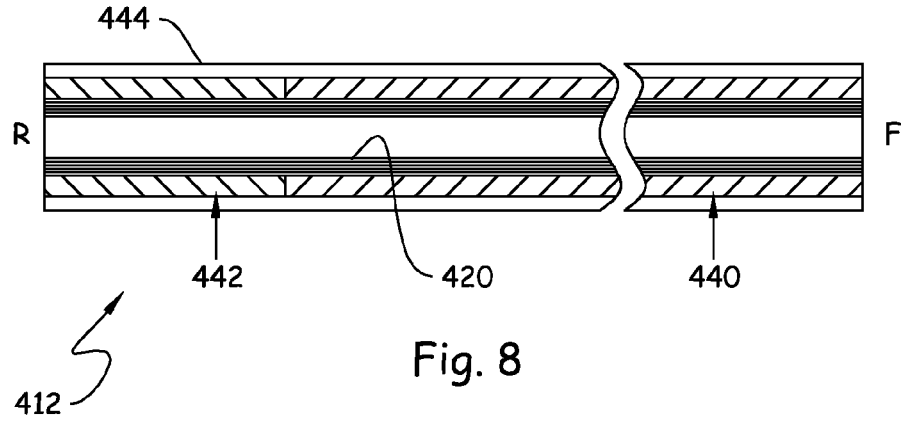
Figure 9:
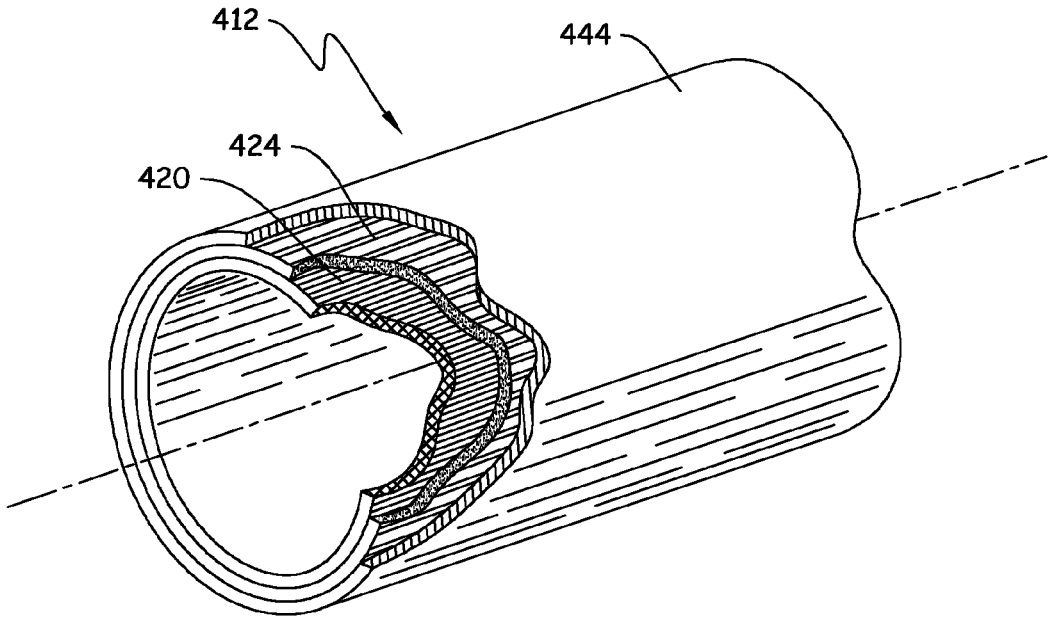

Referring now to FIGS. 8-9, a fourth embodiment of an arrow shaft is shown generally at 412 in cross-section. This fourth embodiment of the arrow shaft 412 is similar to the arrow shaft 12 of the first embodiment, with an additional outer casing 444 applied outside of, and external to the sleeve. In the embodiment of FIGS. 8-9, the shaft 412 includes a hollow tubular core 420, which is essentially the same as the tubular core 20 as previously described. The core 420 may be made of a carbon composite, carbon-containing material or any of the materials discussed above in connection with the core 20.

Further in the embodiment shown in FIGS. 8-9, the shaft 412 is reinforced by placing a first piece of relatively heavy (dense) fabric or other flexible material externally outside of the core 420 at a front portion thereof, to form a front portion 440 of a sleeve 424. The sleeve 424 is sandwiched between the core 420 and an outer casing 444 in this fourth embodiment. The outer casing 444 may be formed from a material similar to the core 420, such as a prepreg made from a carbon composite material, or may be formed from a single fabric section impregnated with a curable resin.

The material used for the front portion 440 of the sleeve 424 has a first density, or weight per standard linear measure, for a given width of the material at a standard thickness thereof.

Further in the arrow shaft 412 according to the fourth embodiment, a second piece of relatively light fabric or other flexible material is placed external to the core 420 at a rear portion thereof, to form a rear portion 442 of the sleeve 424.

The material used for the rear portion 442 of the sleeve has a second density which is less (lighter) than the first density, so that the rear portion 442 of the arrow shaft 412 becomes lighter per standard length than the front portion 440, and the weight of the arrow shaft is distributed with more weight disposed in front of the arrow's midpoint than behind the midpoint. If desired, multiple weight-forward layers may be applied to make the sleeve 424 a laminated member.

The present invention also encompasses a method of making a fabric-reinforced arrow shaft 12, 312 or 412.

Figure 10:
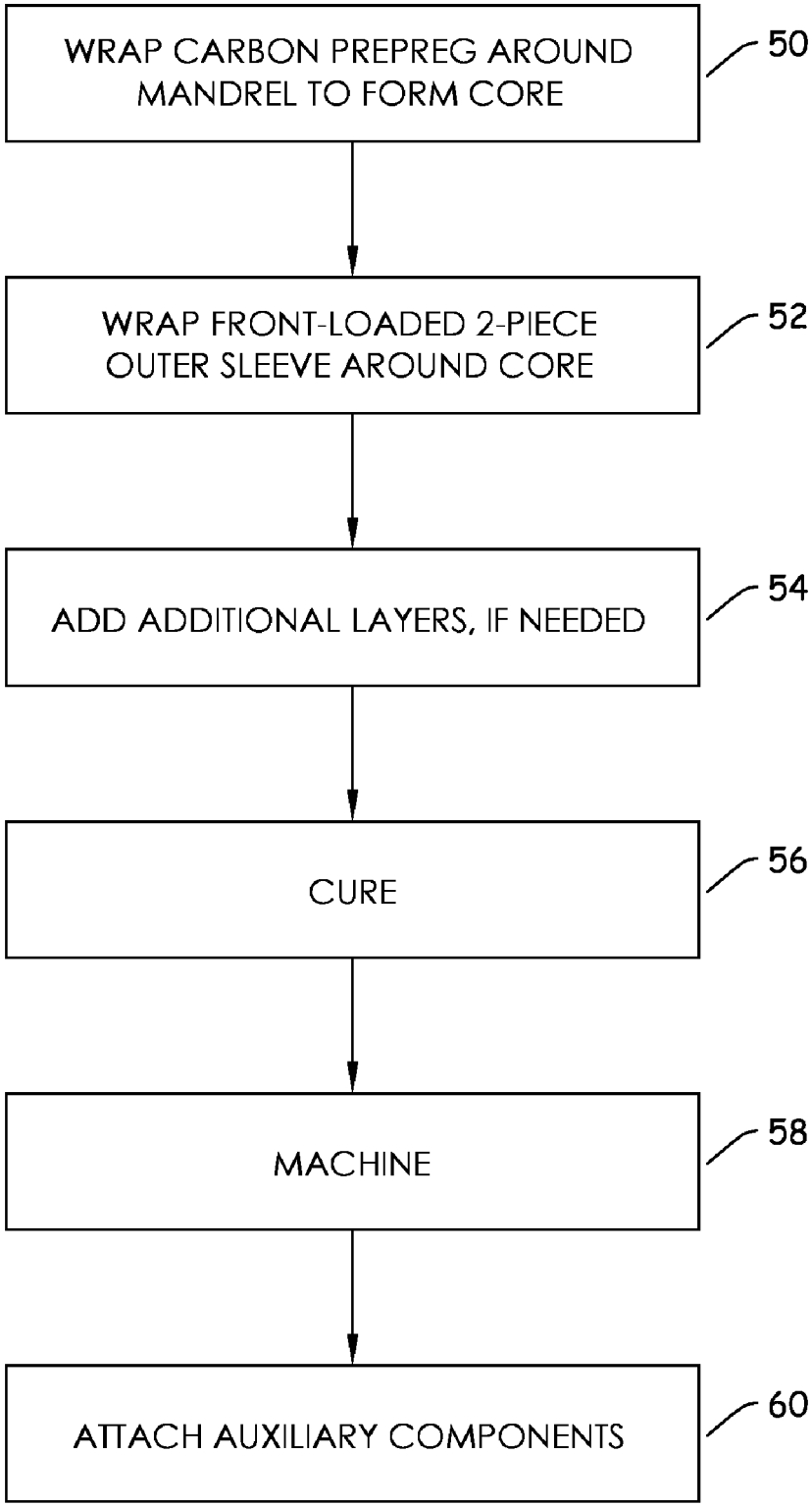

In practicing a method according to a fifth embodiment of the invention, a carbon prepreg sheet is wrapped around a cylindrical mandrel (not shown) to define the core 20. This step is shown at 50 in FIG. 10.

Then, a piece of relatively dense woven or non-woven fabric material 22 is placed in covering relation on a front part of the hollow tubular core 20 to form the front section 40 of the sleeve, and a section of lighter-density material is placed surrounding a rear part of the core 20 to form the rear section 42 of the sleeve. This step is shown at 52 in FIG. 10. This front-loaded sleeve may include multiple fabric layers, if desired.

In an optional step, additional layers may be added to the uncured arrow shaft outside of the sleeve 24. Where used, such additional layers may form an outer casing such as that shown at 444 in FIGS. 8-9. This step is shown at 54 in FIG. 10.

As previously noted, in certain selected illustrative embodiments of the invention, the fabric material 22 or 122 of the front section may be pre-printed or otherwise inscribed with a design or pattern before being applied to the core 20. This also applies to the method hereof.

Another step in the method according to the fifth embodiment is to provide an uncured resin for protecting the fabric, and to apply it to the fabric material 22. As used herein, the term "resin" includes, but is not exclusively limited to, urethanes, varnishes, lacquers, epoxies, paints, and powder coatings.

The resin may be impregnated into the fabric 22, 122, before the fabric is placed on the core 20, or alternatively, the resin may be applied to the sleeve 24 after it is wrapped around the core.

Then, in the method of the fifth embodiment, the resin on the fabric material 22, 122 is cured, to adhere the fabric to the core. The front and rear sections of the sleeve 24 are then cured in place to affix them to the core 20. The core 20 and the sleeve 24, and any other layers, if present, may be cured together in place around the mandrel. This curing step is shown at 56 in FIG. 10. In the curing step, the resin may be applied as a liquid and air-dried, or alternatively, may be a thermosetting resin, which is cured by heating. While not wishing to be bound by any theory, it is believed that the resin material has a tendency to strengthen, reinforce, and protect the fabric material of the sleeve.

Following the curing step, optionally, the shaft 12 may be treated to perform a smoothing operation on the external surface thereof. This may be done by hand or by an appropriate machine. This smoothing operation may be performed by placing the cured shaft 12 in a centerless grinder, and grinding the external surface until it is smooth. This smoothing step is shown at 58 in FIG. 10.

An extra step which may be performed in the method according to the fifth embodiment hereof, which may be optionally performed subsequent to the curing step, but which is not required, is attaching one or more auxiliary accessories to the cured shaft 12, 112. These accessories may include a tip or arrow head 14, fletching 16, and a nock 18. This optional method step is shown at 60 in FIG. 10.

Figure 11:
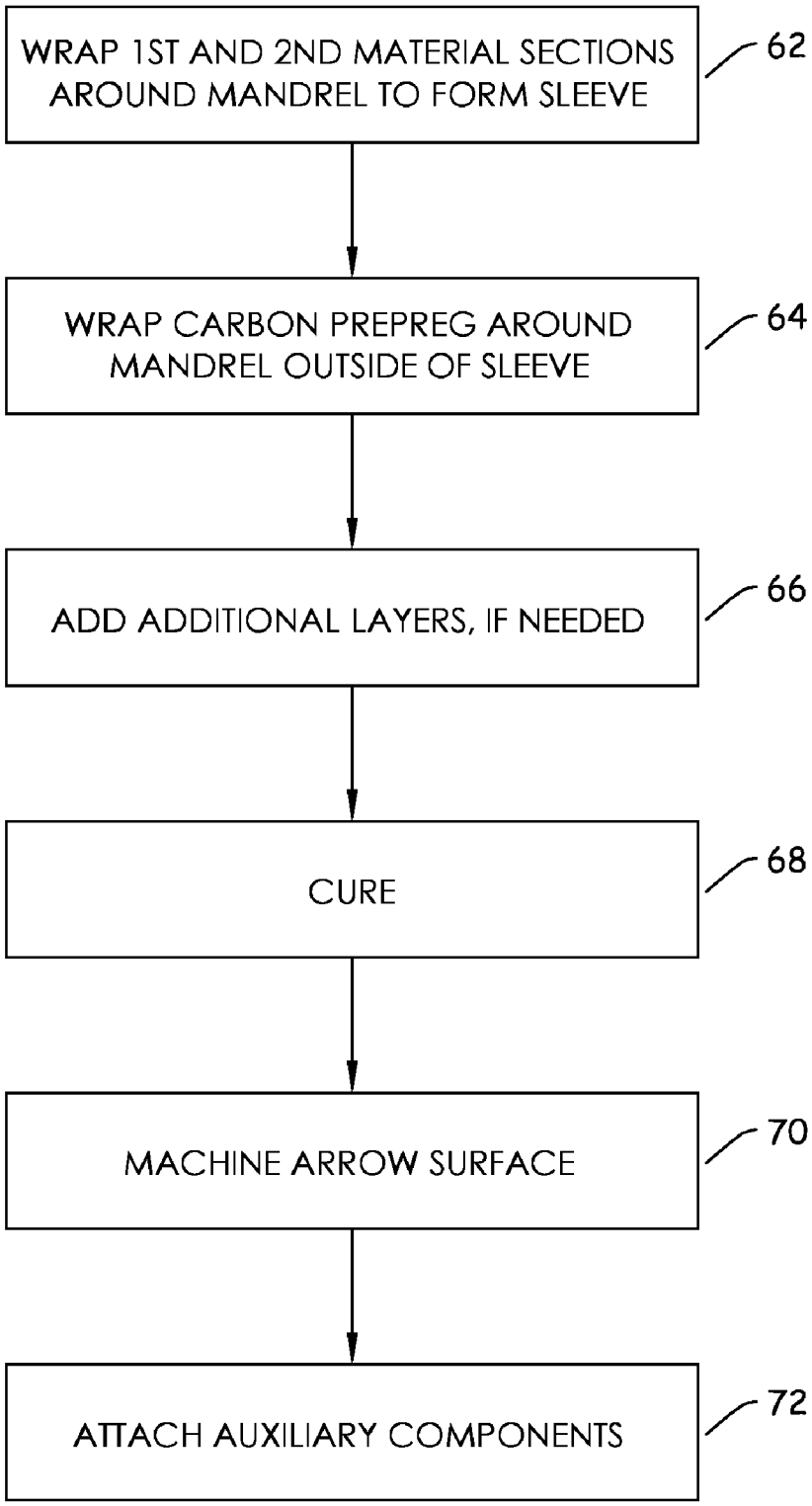

In practicing a method according to a sixth embodiment of the invention, to produce an arrow shaft 312 as shown in FIG. 7, a piece of relatively dense woven or non-woven fabric material is placed in covering relation on a cylindrical rod-shaped mandrel (not shown) to form a front section 340 of an internal sleeve, and a section of lighter-density material is placed surrounding the mandrel to form a rear section 342 of the sleeve. This front-loaded sleeve 340 may include multiple fabric layers, if desired. This step is shown at 62 in FIG. 11.

Another step in the method is to provide an uncured resin for protecting the fabric, and to apply it to the fabric material 22. As used herein, the term "resin" includes, but is not exclusively limited to, urethanes, varnishes, lacquers, epoxies, paints, and powder coatings.

The resin may be impregnated into the fabric 22, 122, before the fabric is placed on the core 20, or alternatively, the resin may be applied to the sleeve 24 after it is wrapped around the core.

Then, one or more carbon prepreg sheets are wrapped around the outside of the sleeve to form a core 320 surrounding the sleeve 324. This step is shown at 64 in FIG. 11.

In an optional step, additional fabric layers may be added to the uncured arrow shaft outside of the sleeve 324 and the core. The exterior fabric layers may have a decorative pattern on an outer surface thereof. Where used, such additional layers may form an outer casing such as that shown at 444 in FIGS. 8-9. This step is shown at 66 in FIG. 11.

As previously noted, in a selected illustrative embodiment of the invention, the fabric material 22 or 122 of the front section may be pre-printed or otherwise inscribed with a design or pattern before being applied to the core 20. This also applies to the method hereof.

Then, in the method of this embodiment, the resin on the fabric material 22, 122 is cured, to adhere the fabric to the core. This curing step is shown at 68 in FIG. 11. The front and rear sections of the sleeve 324 are cured in place to affix them to the core 20. The core 320 and the sleeve 324, and any other layers, if present, may be cured together in place around the mandrel. While not wishing to be bound by any theory, it is believed that the resin material has a tendency to strengthen, reinforce, and protect the fabric material of the sleeve.

Following the curing step, optionally, the shaft 312 may be treated to perform a smoothing operation on the external surface thereof. This may be done by hand or by an appropriate machine. This smoothing operation may be performed by placing the cured shaft 312 in a centerless grinder, and grinding the external surface until it is smooth. This smoothing step is shown at 70 in FIG. 11.

An extra step which may be performed in the method according to the invention, which may be optionally performed subsequent to the curing step, but which is not required, is attaching one or more auxiliary accessories to the cured shaft 12, 112. These accessories may include a tip or arrow head 14, fletching 16, and a nock 18. This step is shown at 72 in FIG. 11.

Although the present invention has been described herein with respect to a number of specific embodiments thereof, the foregoing description is intended to be illustrative, and not restrictive. Those skilled in the art will realize that many modifications of the described embodiment could be made which would be operable. All such modifications which are within the scope of the claims are intended to be within the scope and spirit of the present invention.

Having, thus, described the invention, what is claimed is:

1. An arrow shaft, comprising:

a hollow tubular core which is adapted to be formed into an arrow shaft, said hollow core comprising carbon;

a two-part sleeve, where said sleeve either covers the core externally and is affixed to the core, or is provided as a liner disposed inside of the core and affixed thereto, said sleeve having a substantially constant inside and outside diameter throughout substantially its entire length;

wherein a first part of the sleeve is disposed toward the front of the arrow shaft and comprises a first sleeve section formed of a fabric material and having a first density, and a second part of the sleeve is disposed toward the rear of the arrow shaft and comprises a second sleeve section which is less dense than the first sleeve section, whereby a front portion of the arrow shaft weighs more per inch than a rear portion thereof;

and an adhesive resin material associated with the sleeve;

wherein the resin helps to adhere the sleeve to the core.

2. The arrow shaft of claim 1, wherein the shaft has a substantially constant inside diameter and a constant outside diameter throughout substantially the entire length thereof.

3. The arrow shaft of claim 1, wherein the sleeve is disposed outside of the core.

4. The arrow shaft of claim 3, further comprising an outer casing disposed outside of the sleeve and affixed thereto, whereby the sleeve is sandwiched between the core and the outer casing.

5. The arrow shaft of claim 1, wherein the sleeve is disposed inside of the core.

6. The arrow shaft of claim 1, wherein the first sleeve section has a design or pattern thereon.

7. The arrow shaft of claim 1, wherein the exterior of the two-part sleeve is treated to form a smooth surface on an exterior surface thereof.

8. The arrow of claim 1, wherein said resin material is selected from the group consisting of urethanes, varnishes, lacquers, epoxies, paints, and powder coatings.

9. The arrow shaft of claim 1, wherein the first part of the sleeve further comprises metal screening, foil, or metal tubing.

10. An arrow, comprising:

a hollow tubular core;

a two-part sleeve having a substantially constant inside and outside diameter throughout substantially its entire length, where said sleeve either covers the core externally and is affixed to the core, or is provided as a liner disposed inside of the core and affixed thereto, the core and sleeve cooperating to define an arrow shaft, wherein a first part of the sleeve is disposed toward the front of the arrow shaft and comprises a first sleeve section formed of a fabric material and having a first density, and a second part of the sleeve is disposed toward the rear of the arrow shaft and comprises a second sleeve section which is less dense than the first sleeve section, whereby a front portion of the arrow shaft weighs more per inch than a rear portion thereof;

an adhesive resin material associated with the two-part sleeve; and at least one auxiliary attachment connected to said arrow shaft, said auxiliary attachment selected from the group consisting of arrow heads, fletching, and nocks.

11. The arrow of claim 10, wherein the first part of the sleeve further comprises metal screening, foil, or metal tubing.

12. An arrow shaft, comprising:

a hollow tubular core which is adapted to be formed into an arrow shaft, said hollow core comprising carbon;

a two-part sleeve, where said sleeve either covers the core externally and is affixed to the core, or is provided as a liner disposed inside of the core and affixed thereto, said sleeve having a substantially constant inside and outside diameter throughout substantially its entire length;

wherein a first part of the sleeve is disposed toward the front of the arrow shaft and comprises a first sleeve section formed of a fabric material and having a first density, and a second part of the sleeve is disposed toward the rear of the arrow shaft and comprises a second sleeve section which is less dense than the first sleeve section, whereby a front portion of the arrow shaft weighs more per inch than a rear portion thereof;

and an adhesive resin material associated with the sleeve, wherein the resin helps to adhere the sleeve to the core;

and wherein the shaft has a substantially constant inside diameter and a substantially constant outside diameter throughout substantially the entire length thereof.

13. The arrow shaft of claim 12, further comprising an outer casing disposed outside of the sleeve and affixed thereto, whereby the sleeve is sandwiched between the core and the outer casing.

14. The arrow shaft of claim 12, wherein the first part of the sleeve further comprises metal screening, foil, or metal tubing.

* * * * *